United States Patent [19]

Morini

[11] 4,397,111

[45] Aug. 9, 1983

[54] PISTOL, IN PARTICULAR FOR OLYMPIC FIFTY METER COMPETITION SHOOTING

[76] Inventor: Cesare Morini, Via Trieste, 14 - Parma, Italy

[21] Appl. No.: 207,444

[22] Filed: Nov. 17, 1980

[51] Int. Cl.[3] ..... F41C 3/00; F41C 11/00; F41C 19/00; F41C 21/22

[52] U.S. Cl. ..... 42/73; 42/69 R; 42/75 B; 42/75 C; 42/1 S

[58] Field of Search ..... 42/73, 1 S, 75 B, 75 A, 42/69 R, 75 C, 76 R

[56] References Cited

U.S. PATENT DOCUMENTS

| | | | |
|---|---|---|---|
| 1,047,690 | 12/1912 | Oliver | 42/75 C |
| 2,631,398 | 3/1953 | Fantoni | 42/73 |
| 3,945,142 | 3/1976 | Keppeler | 42/1 S |

FOREIGN PATENT DOCUMENTS

| | | | |
|---|---|---|---|
| 491018 | 1/1976 | U.S.S.R. | 42/75 A |

*Primary Examiner*—Charles T. Jordan
*Assistant Examiner*—Ted L. Parr
*Attorney, Agent, or Firm*—Browdy & Neimark

[57] ABSTRACT

The pistol is provided with two supports that carry the front sight and the rear sight notch, respectively, which can be rotated around the barrel of the pistol in such a way as to carry the line of aim into various positions. Furthermore, the invention pistol is provided with a frame that connects the barrel of the pistol to the grip thereof so as to allow vertical and horizontal movements of the barrel and the grip to be made, one with respect to the other. The firing mechanism of the pistol is connected to the grip thereof but is detached from the remaining elements of the said pistol.

10 Claims, 7 Drawing Figures

33
17
12
37
37b
37f
39a
14a
39
44
40
16
35
14
43
10
11
41
21a
21
25a
10a
25
22
23
6
2
2a
2b
19
3
13
19a
31
55
56
31a
35a
30
36
35f
35b
37a
39b
32
38
1
5
5
3
1a
1b
19
4
4a

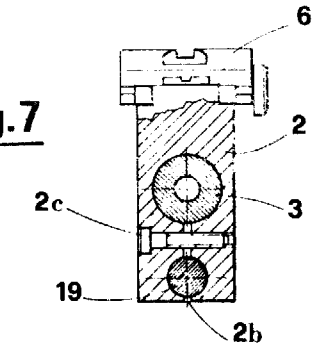
Fig.7
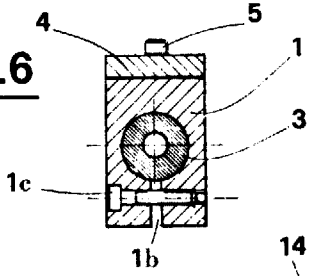
Fig.6
Fig.5
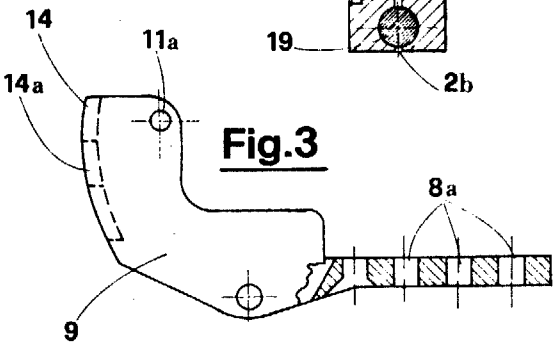
Fig.3
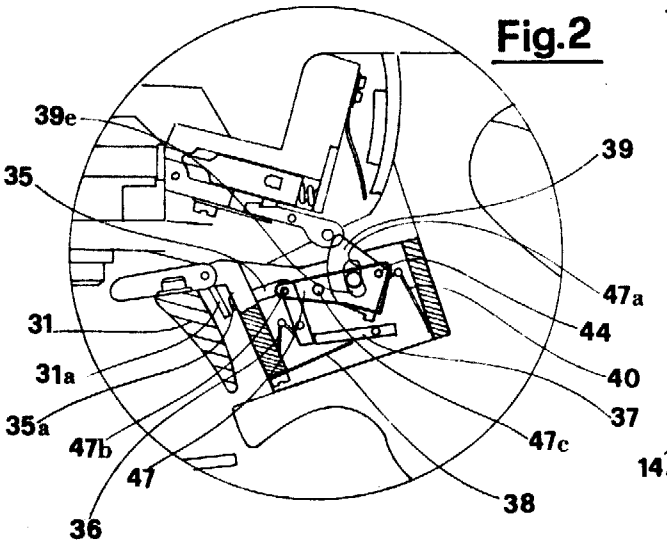
Fig.2
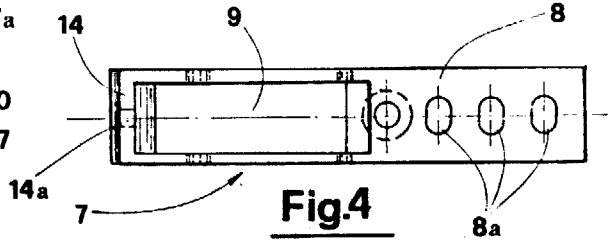
Fig.4

PISTOL, IN PARTICULAR FOR OLYMPIC FIFTY METER COMPETITION SHOOTING

The invention relates to a pistol, in particular for Olympic fifty meter competition shooting.

The target shooting "fifty meter free pistol" speciality calls for the use of an extremely precise and sophisticated fire-arm.

Pistols of this type currently in use present the considerable problem of having to be especially constructed or adapted for the individual marksman since, between one person and another, there is a difference both in the style of shooting and in the anatomic conformation of the hand and wrist.

One object of the invention is to make available a pistol that can be adapted, in a fast and easy way, to the requirements of each individual marksman.

A further object of the invention is to make available a pistol provided with highly sensitive firing mechanism.

Yet another object of the invention is to make available a pistol whose striker device guarantees, at each shot, the unfailing explosion of the powder contained in the cartridge case.

These and other objects are all attained with the pistol of the invention, essential features of which include: a first support and a second support, the former provided with the front sight and the latter with the rear sight notch, so connected to the barrel of the pistol that it be possible to rotate them around the barrel and to secure them in any one of the positions reached through the rotation; a frame constituted essentially by a drilled plate and by a shaped fork inside of which the breech-block is housed, that can be connected integrally to the grip of the pistol in a plurality of angularly separate positions arranged in one and the same vertical plane, it being possible to connect the barrel of the pistol integrally to the drilled plate in a plurality of angularly separate positions arranged in one and the same horizontal plane; and firing mechanism, comprising a trigger and a device for transmitting the motion of the trigger to the firing pin, connected integrally to the grip of the pistol and detached from the remaining elements thereof.

Further characteristics and advantages of the invention will become more apparent from the detailed description that follows of one preferred but not sole embodiment of the pistol forming the subject of the invention, illustrated purely as an unlimited example in the accompanying drawings, in which:

FIG. 2 shows, in a vertical elevation, a longitudinal section of the firing mechanism, with the gunlock not ready for firing;

FIG. 3 shows, in a vertical elevation, a view of the frame of the pistol, with certain parts in section;

FIG. 4 shows, in a plan view, the frame of the pistol;

FIG. 5 shows, in a front view, the breech-block of the pistol;

FIG. 6 shows, along the line VI—VI in FIG. 1, one section of the first support; and FIG. 7 shows, along the line VII—VII in FIG. 1, one section of the second support.

Figure 1:
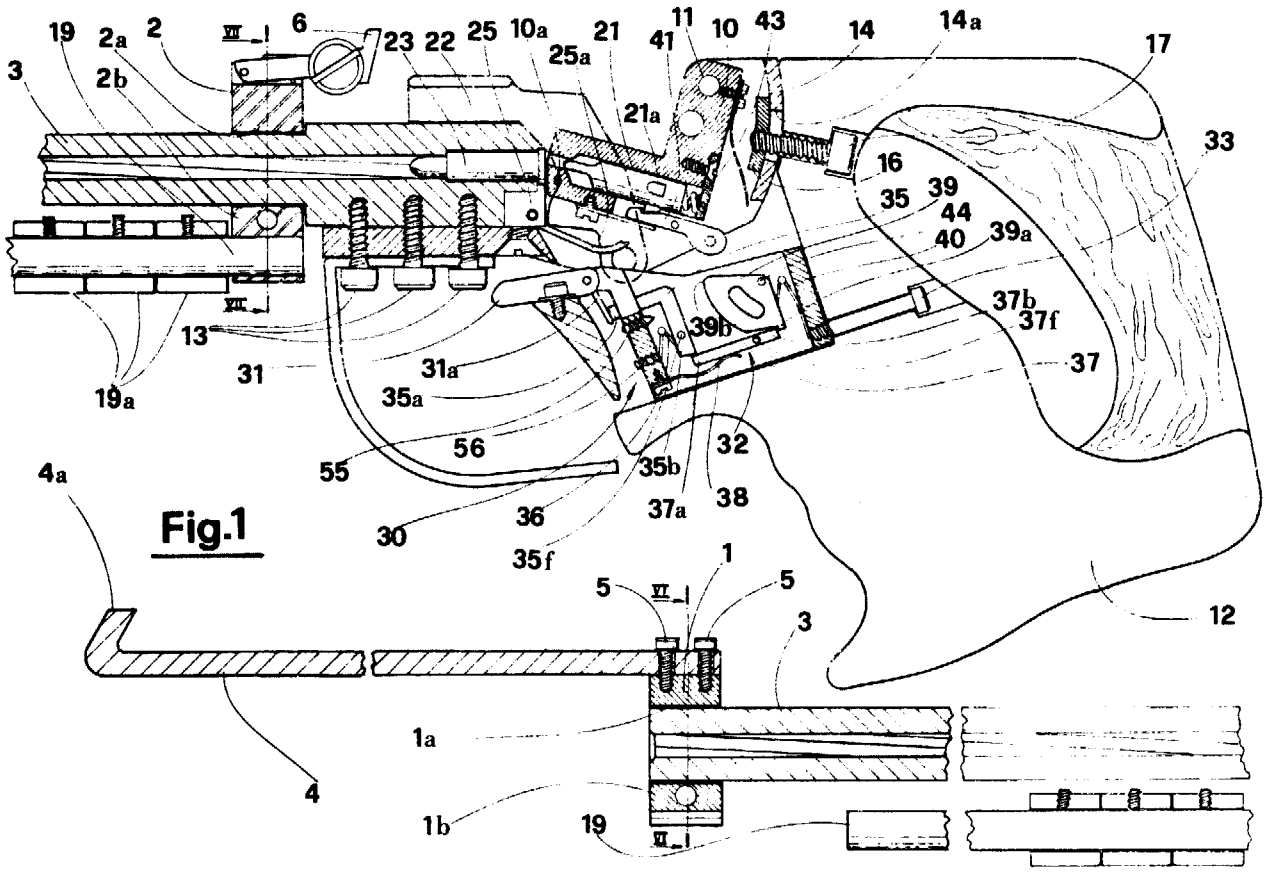
FIG. 1 shows, in a vertical elevation, a longitudinal section of the pistol of the invention, in which the barrel has been shown broken off and reproduced in the lower part of the page.

The invention pistol comprises a first support (1) and a second support (2), each provided with a through hole (1*a*) and (2*a*), respectively, both with a circular section of approximately the same outside diameter as the barrel (3) of the pistol. Furthermore, each support is provided with a through slot (1*b*) and (2*b*), respectively, that is placed parallel to the axis of the corresponding hole and connects the inside of the hole with an external surface of the support.

The support (1) is provided with the front sight (4*a*) made at one extremity of a long rod (4), the other extremity of which is connected integrally, via the screws (5), to the support (1). The support (2) carries the rear sight notch (6).

The supports (1) and (2) are threaded onto the barrel (3) and can be rotated around the barrel. Provision is made for tightening means, constituted by the screws (1*c*) and (2*c*), for causing the faces of each flute to approach one another in such a way as to lock the holes (1*a*) and (2*a*) on the barrel and to thus fix the supports (1) and (2) thereto in any one of the positions reached through the rotation of the supports around the barrel.

The line of aim, defined by the front sight (4*a*) and the notch (6) can, in this way, adopt various positions with respect to the grip (12) of the pistol, that are parallel with one another and, therefore, allow the marksman to rotate the wrist and arm to a preferred position when shooting.

The support (1) is fixed to the free extremity of the barrel. The front sight (4*a*), situated at the extremity of the rod (4), is thus carried very far away from the eye, and this makes faster and more precise alignment with the target possible. Furthermore, the support (2) has connected to it a second rod (19) on which are threaded the counter weights (19*a*) that can be displaced along the rod (19), the purpose of this being to balance the fire-arm, particularly in order to deaden the firing recoil.

The frame (7) of the pistol is essentially constituted by a drilled plate (8) and a shaped fork (9) inside which the breech-block (10) of the pistol is housed. The breech-block is pivoted to a pin (11) thread into the holes (11*a*) made in the prongs of the fork (9).

The plate (8) is provided with three elongated through holes (8*a*). The barrel (3) of the pistol is provided with threaded holes and is secured to the plate (8) by means of the screws (13) which pass through the holes (8*a*). Since the latter are placed transversely with respect to the barrel of the pistol, the screws (13) can be displaced slightly in the crosswise direction, and thus the barrel can be connected to the frame in a plurality of angularly separate positions, all of which are placed in one and the same horizontal plane.

Connected integrally to the rear part of the prongs of the fork (9) there is a connecting plate (14) which comprises an elongated through hole (14*a*) placed substantially vertically.

The plate (14) is maintained in contact with the grip (12) by means constituted by a small plate (16) provided with a threaded hole and by a screw (17). The latter passes through the elongated hole (14*a*). The frame (7) can, in this way, be displaced in a vertical direction before being locked, and it can be connected integrally to the grip (12) in a plurality of angularly separate positions. A displacement of the barrel naturally accompanies a displacement of the frame.

The displacements in a horizontal plane and in a vertical plane of the barrel of the pistol make possible horizontal and vertical adjustments of the rear sight. Each individual marksman is thus able to match the pistol to the anatomic conformation and to the most natural positions of his or her wrist.

The displacements the barrel undergoes are obviously very slight since, with the target being a considerable distance away, a small angular displacement of the barrel results in the aim being corrected considerably.

The pistol comprises, furthermore, a firing pin (21) housed inside the breech-block (10). When the pistol is operated by means of the lever (22), the firing pin (21) is in a position such, as shown in FIG. 1, that the motion through which it approaches the cartridge (23), inserted in the barrel, takes place in a direction inclined with respect to the axis of the said cartridge.

In this way, despite the contact between the cartridge and the firing pin occurring in a peripheral area of the former, a considerable number of particles of explosive contained in the cartridge succeed in being excited, and this is because the striking of the cartridge in the direction of the outer border thereof is avoided since this would deaden notably the shot. When the shot has been exploded, the raising of the operating lever (22) causes a projection (21*a*) of the firing pin to be pressed against and a spring (43), placed to the rear of the latter, to be partially loaded. Once the lever (22) releases a second projection (10*a*) of the breech-block, the spring (43) causes the latter to rotate and thus to be lowered.

As the breech-block is lowered, it rests against a tail piece (25*a*) of the extractor (25) and this causes the cartridge case to be expelled from the barrel.

The invention pistol comprises, furthermore, firing mechanism (30) consisting of a trigger (31) and a device (32) for transmitting the motion of the trigger to the firing pin. The firing mechanism is connected integrally to the grip (12) of the pistol by means of the screw (33), and it is detached from the remaining elements of the pistol. In this way, regardless of any veritcal or horizontal adjustment that may be made to the rear sight of the pistol, the position of the trigger stays stationary with respect to the grip of the pistol.

The device (32) comprises, in turn, a first lever (35) in the form of an "L", the first extremity (35*a*) of which, when the device is ready to be tripped, is thrust into contact with the tail piece (31*a*) of the trigger (31) by first elastic means constituted by a helical cantilever spring (36). The fulcrum (35*f*) of the lever (35) is placed in proximity of the second extremity (35*b*) of the lever. The device (32) comprises, furthermore, a second lever (37), the first extremity (37*a*) of which, when the device is ready to be tripped, is thrust against the extremity (35*b*) of the lever (35) by second elastic means constituted by a flat spring (38). The fulcrum (37*f*) of the lever (37) is placed in proximity of the second extremity (37*b*) of the lever. The device (32) comprises, furthermore, a hammer (39), pivoted at a fixed axis (44) with respect to the firing mechanism, provided with a sear (39*a*) which, when the device is ready to be tripped, is thrust against the extremity (37*b*) of the lever (37) by third elastic means constituted by a helical cantilever spring (40). The profile (39*b*) of the hammer (39) strikes, at the time the device is being tripped, against the hook shaped lever (41) that restrains the firing pin.

When the trigger is squeezed, the tail piece (31*a*) thereof presses against the extremity (35*a*) of the lever (35) and causes the forward displacement of the extremity (35*b*) of the latter in such a way as to permit the clockwise rotation of the lever (37) caused by the spring (38).

The hammer (39), thrust by the spring (40), can thus effect a clockwise rotation. The profile (39*b*) of the hammer thus strikes against the hook shaped lever (41). The impact causes the release of the hook shaped lever (41) of the firing pin and leaves free the latter, which thrust by the spring (43), hits against the cartridge causing the shot to be fired.

The system of levers and springs used renders the device (32) particularly sensitive. To regulate the sensitivity of the device, an adjustment can be made to either the screw (55), whereby the area of contact between the extremity (35*b*) of the lever (35) and the extremity (37*a*) of the lever (37) can be increased or decreased, or else to the screw (56) that regulates the force applied by the spring (36) to the lever (35).

After the pistol has been fired, the configuration of the device (32) is as shown in FIG. 2. To prepare afresh the device (32) for firing, provision is made for a third lever (47), movable in a plane parallel to that in which the hammer (39) moves and pivoted to the pin (44) of the said hammer. The lever (47) is provided with a first pin (47*a*), placed on an axis parallel to the pin (44), which engages in a slot (39*c*) machined into the hammer (39). Furthermore, it is provided with a second pin (47*b*), placed on an axis parallel to the pin (44) in such a way as to extend out of the firing mechanism, and with a third pin (47*c*), also on an axis parallel to the pin (44). In order to prepare the device (32) for tripping, the pin (47*b*) is lowered manually and the lever (47) is made to rotate around the pin (44). The first pin (47*a*) carries the hammer (39) in rotation, while the third pin (47*c*) of the lever (47) comes into contact with the lever (37) and causes the counter clockwise rotation of this part.

In this way, the extremity (35*b*) of the lever (35), thrust by the spring (36), is returned above the lever (37), the sear (39*a*) of the hammer (39) returns against the extremity (37*b*) of the lever (37), and the device (32) is ready once more to be tripped.

Numerous modifications of a practical nature may be made to the constructional details of the invention without there being any deviation whatsoever from the framework of protection afforded to the conceptual idea as claimed hereinafter.

I claim:

1. Pistol, in particular for Olympic fifty meter competition shooting, comprising a first support and a second support, a front sight mounted on said first support, a rear sight notch mounted on said second support, said pistol comprising a barrel, means to mount said first and second supports with said first sight and said rear sight mounted thereon, respectively, on said pistol barrel in a manner permitting said first and second supports to rotate around the axis of said barrel and to permit said first and second supports to be secured to said barrel at any selected position obtained by rotation of said supports about said barrel, said pistol comprising a frame, said frame consisting essentially of a drilled plate and a shaped fork, said pistol comprising a breech-block, means to mount said breech-block within said shaped fork, said pistol comprising a grip, means to mount said frame to said grip at any one of a plurality of angularly spaced separate positions all lying in essentially the same vertical plane, means to connect said barrel to said drilled plate at any one of a plurality of angularly spaced separate positions arranged in essentially the same horizontal plane, said pistol comprising firing mechanism, said firing mechanism comprising a trigger and a firing pin, and means for transmitting the motion of said trigger to said firing pin, and means to connect said firing mechanism to said grip of said pistol separately from the remaining elements of said pistol.

2. Pistol according to claim 1, wherein said front sight comprises elongated rod means, the front end of said rod means being formed into said front sight, and means for connecting the other end of said rod means to said first support.

3. Pistol according to claim 1, wherein each of said first and second supports are formed with a through hole having a cross-sectional shape substantially the same as and slightly larger than the cross-sectional shape of said barrel, each of said first and second supports being formed with a through slot placed parallel to the axis of said hole therein, said slot interconnecting the inside of said hole with an external surface of each of said supports, and each of said first and second supports further comprising tightening means adapted to cause the faces defined by said through slots to approach one another to thereby adjustably fix each respective support in said adjusted position of said support with respect to said barrel.

4. Pistol according to claim 1, wherein said drilled plate of said frame is formed with a plurality of elongated through holes, and said holes being placed transversally with respect to said barrel of said pistol.

5. Pistol according to claim 1, a connecting plate, said shaped fork comprising prongs the rear portions of which are connected to said connecting plate, means to mount said connecting plate in contact with said grip of said pistol, said connecting plate comprising a through hole located in a substantially vertical position, and means to mount said connecting plate to said grip of said pistol at a adjusted position therein in said vertical plane.

6. Pistol according to claim 1, means to mount said firing pin in said pistol such that the firing motion of said pin is inclined with respect to the axis of said barrel, whereby said firing pin will strike a cartridge in said pistol at an angle substantially equal to the angle at which said firing pin is inclined with respect to the axis of said barrel.

7. Pistol according to claim 1, wherein said means for transmitting said motion of said trigger to said firing pin comprises a first lever of generally "L" shape having a first extremity, a fulcrum, and a second extremity, first elastic means biasing said first lever when the pistol is ready to be fired into contact with said trigger, said fulcrum of said first lever being located in a spaced predetermined position along said second extremity of said first lever, a second lever comprising a first extremity, a fulcrum, and a second extremity, second elastic means thrusting the first extremity of said second lever when the pistol is ready to be fired against said second extremity of said first lever, said fulcrum of said second lever being located in a spaced position along said second extremity of said second lever, a hammer, means to pivot said hammer at a fixed axis with respect to said firing mechanism, said hammer comprising a sear, a hook-shaped lever restraining said firing pin, third elastic means adapted to thrust said sear when the pistol is ready to be fired against said second extremity of said second lever, and said hammer being profiled such that it will strike against, at the time of firing, said hook-shaped lever to thereby release said hook-shaped lever from said firing pin to cause said firing pin to move in a firing direction.

8. Pistol according to claim 7, wherein said second elastic means comprises a flat spring.

9. Pistol according to claim 7, wherein said first elastic means and said third elastic means each comprise helical compression springs.

10. Pistol according to claim 7, wherein said hammer is formed with a slot, said means for transmitting the motion of said trigger to said firing pin comprising a third lever, means to mount said third lever for motion in a plane parallel to the plane in which said hammer moves, means to pivotally mount said third lever about a common axis with said hammer; said third lever comprising a first pin, a second pin, and a third pin; said third lever first pin comprising an axis parallel to said hammer and third pin common axis and which engages in said hammer slot, said third lever second pin comprising an axis located substantially parallel to said common axis and arranged so as to extend outwardly of said firing mechanism for manual manipulation thereof, and said third lever third pin being adapted to come into contact, when said pistol is cocked for firing, with said second lever.

* * * * *